US009029674B2

(12) United States Patent
Gold

(10) Patent No.: US 9,029,674 B2
(45) Date of Patent: May 12, 2015

(54) FOLDABLE MUSICAL KEYBOARD PLAYER

(71) Applicant: Jared Gold, Ridgefield, NJ (US)

(72) Inventor: Jared Gold, Ridgefield, NJ (US)

( * ) Notice: Subject to any disclaimer, the term of this patent is extended or adjusted under 35 U.S.C. 154(b) by 0 days.

(21) Appl. No.: 14/463,771

(22) Filed: Aug. 20, 2014

(65) Prior Publication Data

US 2015/0053063 A1 Feb. 26, 2015

Related U.S. Application Data

(60) Provisional application No. 61/868,628, filed on Aug. 22, 2013.

(51) Int. Cl.
*G10D 3/12* (2006.01)
*G10C 3/12* (2006.01)

(52) U.S. Cl.
CPC ..... *G10C 3/12* (2013.01)

(58) Field of Classification Search
CPC ..... G10C 3/12
See application file for complete search history.

(56) References Cited

U.S. PATENT DOCUMENTS

| | | | | |
|---|---|---|---|---|
| 984,465 | A | 2/1911 | Betz | |
| 1,152,475 | A | 9/1915 | Bilhorn | |
| 1,742,341 | A | 11/1927 | Bukow | |
| 2,722,154 | A | 11/1955 | Neumark | |
| 3,478,159 | A * | 11/1969 | Olson | 84/719 |
| 3,776,091 | A | 12/1973 | Suzuki | |
| 4,106,388 | A | 8/1978 | Franz | |
| 4,376,402 | A | 3/1983 | Helpinstill | |
| 4,378,881 | A | 4/1983 | de Vries | |
| 5,463,925 | A | 11/1995 | Galocy | |
| 5,507,215 | A | 4/1996 | Lin | |
| 6,259,006 | B1 | 7/2001 | Parienti | |
| 6,575,647 | B1 | 6/2003 | Daniel | |
| 6,875,913 | B2 * | 4/2005 | Bubar | 84/423 R |
| 7,465,868 | B2 | 12/2008 | Lengeling | |
| 2005/0241467 | A1 | 11/2005 | Lo | |

(Continued)

FOREIGN PATENT DOCUMENTS

| | | |
|---|---|---|
| CN | 2583726 | 10/2003 |
| CN | 2741143 | 11/2005 |

(Continued)

OTHER PUBLICATIONS http://gadgets.boingboing.net/2007/10/26/vax-77-folding-music.html (Retrieved from internet Feb. 25, 2013).

*Primary Examiner* — Robert W Horn
(74) *Attorney, Agent, or Firm* — Gearhart Law LLC

(57) ABSTRACT

There is a foldable musical keyboard player can convert from a deployed configuration to at least a first and a second folding configuration. In the deployed configuration, the top keyboard of the player is flipped up, exposing the music keys on both the top keyboard and the bottom keyboard. Such a configuration allows access to all the music keys and the control panel of the player, enabling the user to play music. By flipping down the top keyboard that covers the bottom keyboard, the player is converted into the first folding configuration, which transforms the player from a format adapted for playing to another more suitable for transport. By using a number of hinges and adjusting the fastening assemblies, the user may fold the keyboard player again, converting to the second folding configuration, which makes the musical keyboard player compact in occupied space and easy to transport and store.

18 Claims, 7 Drawing Sheets

(56) References Cited

U.S. PATENT DOCUMENTS

2009/0266218 A1* 10/2009 Parienti ..... 84/171
2015/0053063 A1* 2/2015 Gold ..... 84/423 R

FOREIGN PATENT DOCUMENTS

JP 2003099057 4/2003
JP 2008233887 A * 10/2008

* cited by examiner

FOLDABLE MUSICAL KEYBOARD PLAYER

CLAIM OF PRIORITY

This application claims the priority of U.S. Ser. No. 61/868,628 filed on Aug. 22, 2013, the contents of which are fully incorporated herein by reference.

FIELD OF THE INVENTION

The current invention relates to a foldable musical keyboard player used for playing music and foldable for easy transportation. In particular, the current invention relates to a musical keyboard player that may be closed and folded so that the keyboard player is converted to a more compact configuration that is convenient to carry around and store.

BACKGROUND OF THE INVENTION

Due largely to their versatility and adaptability, musical keyboards have become a more and more essential part of modern day music instruments. One other important advantage of the musical keyboard vs. the piano is its relatively improved portability. However, comparing with instruments such as guitars, the conventional keyboard player is still bulky and difficult to carry around, making it more inconvenient to the users and the band. While it is desirable to make the musical keyboard more portable, the presence of music keys limits that attempts to reduce the actual size of the keyboard player. Other solutions are thus important and one of such solutions is to make the keyboard players foldable or collapsible. In particular, it is much more desirable to make the two-level keyboard fordable because this kind of keyboard is usually larger and heavier compared with the single-level keyboards.

While several disclosures cover such designs, all the other teachings fail to address important aspects of the problem, except the current invention, which satisfies all the important requirements and confers other benefits that are outlined hereinafter.

Examples of related patents:

U.S. Pat. No. 5,463,925 ('925 patent) discloses an electronic music keyboard that folds in the middle bottom-to-bottom, and pivots in the middle, back-to-back. When fully open along both planes, the keyboard looks and performs in a conventional manner. When partially pivoted, the keyboard may be supported by an ergonomic belt, or standard means and played hanging from the body of the operator forming an adjustable, inverted "V" shape on a vertical axis. When fully pivoted, the keyboard may be worn over the chest of the operator and played much like a double-keyboard accordion. The ends form a carrying handle and the keyboard folds neatly into a carry bag. This device may also be fabricated from appropriate materials to act as a support for prior art small MIDI keyboards.

In addition, U.S. Pat. No. 6,875,913 ('913 patent) discloses a musical keyboard that is collapsible between a deployed configuration and an undeployed configuration. The musical keyboard including two or more modules, each module containing a different subset of a set of musical keys; and means for collapsing the modules from the deployed configuration in which the modules are arranged in a row to form the musical keyboard, the keyboard being substantially planar, to the collapsed configuration in which the modules are substantially positioned on top of each other.

In summary, various apparatus are known in the art, but their structures are distinctively different from the current invention. Moreover, the other inventions fail to address all of the problems solved by the invention described herein. One embodiment of this invention is illustrated in the accompanying drawings and will be described in more detail herein below.

SUMMARY OF THE INVENTION

The current invention discloses a foldable musical keyboard player, comprising: a bottom keyboard having a bottom keyboard left section and bottom keyboard right section; a flippable top keyboard connected to the bottom keyboard with a plurality of horizontal hinges, allowing the flippable top keyboard to flip, pivot against, and cover the bottom keyboard, the flippable top keyboard having a top keyboard left section and a top keyboard right section; and a least one fastening assembly, wherein the top keyboard left section lays upon the bottom keyboard left section when the flippable top keyboard covers the bottom keyboard, the top keyboard right section lays upon the bottom keyboard right section when the flippable top keyboard covers the bottom keyboard, locking the fastening assemblies keeps the bottom keyboard left section and bottom keyboard right section longitudedly aligned and keeps the top keyboard left section and top keyboard right section longitudedly aligned, and releasing the fastening assemblies allows the top keyboard left section, together with the bottom keyboard left section to be folded against the bottom keyboard right section with the top keyboard right section using at least one vertical hinge.

It should be noted that the flippable top keyboard, though named thereof, may simply comprise a flippable cover without any music keys and having a left section and a right section that overlap with the left section and right section of the bottom keyboard. The essential feature of the current musical keyboard is that it can be converted first from a deployed configuration, which is suitable for playing, to a first folding configuration, which is suitable for recess or short transport, to a second folding configuration, which is a complete left-and-right folding of the keyboard player, resulting in a compact arrangement of the keyboard player and much higher level of portability.

The foldable musical keyboard player may further comprise a top back member disposed upon the bottom keyboard and in parallel with the flippable top keyboard, wherein the top back member has a top back member left section and a top back member right section, the top back left section, together with the top keyboard left section, covers the bottom keyboard left section, and the top back right section, together with top keyboard right section, covers the bottom keyboard right section. In addition, the top back left section may be connected to the top back right section with a second vertical hinge, wherein the top back member left section folds against the top back member right section along the second vertical hinge.

The positioning of the fastening assemblies and the hinges determines how in particular the keyboard player may be folded. If the fastening assembly attaches to the left and right sections of the bottom keyboard and the vertical hinges are positioned on the top keyboard, then the keyboard player of the current invention is preferably folded along the vertical hinges that results in a direct pivoting of the left section and right section of the top keyboard against one another, after releasing the fastening assemblies. On the other hand, the fastening assemblies may attach to the flippable top keyboard, while the vertical hinges connect the left and right sections of the bottom keyboard. Such a design allows splitting of the top keyboard and bending of the bottom keyboard. Both formats are acceptable.

The design of the fastening assembly may vary, as long as the fastening assembly is capable of affixing the left section of the bottom/top keyboard to the right section of the bottom/top keyboard and maintaining a longituded alignment. In particular, the fastening assembly may comprise a fastening pin and two anchoring members, wherein the fastening assembly is locked when the fastening pin attaches to the two anchoring members simultaneously.

Various components of the foldable musical keyboard player may be made from the same or different materials. For example, the fastening assembly is preferred to be made from robust and durable material, such as but not limited to metal, glass, fiberglass, and rigid plastic.

In general, the present invention succeeds in conferring the following, and others not mentioned, desirable and useful benefits and objectives.

It is an object of the present invention to provide a foldable musical keyboard player that may be folded twice.

It is an object of the present invention to provide a foldable musical keyboard player that is easy to transport after complete folding.

It is an object of the present invention to provide a foldable musical keyboard player that covers both single-level and two-level keyboard players.

It is another object of the current invention to provide a foldable musical keyboard player that may be converted from a deployed configuration to a first folding configuration to a second folding configuration.

It is still another object of the current invention to provide a foldable musical keyboard player that allows easy adjustment and folding.

It is another object of the current invention to provide a foldable musical keyboard player that may be folded left against right.

It is another object of the current invention to provide a foldable musical keyboard player that is compact after folding and allows convenient placement and storage.

It is yet another object of the current invention to provide a foldable musical keyboard player that is easy to use and easy to manufacture.

It is another object of the current invention to provide a foldable musical keyboard player that includes fastening assemblies that lock the musical keyboard when it is not folded.

It is yet another object of the current invention to provide a foldable musical keyboard player that includes fastening assemblies that may be conveniently released.

DESCRIPTION OF THE PREFERRED EMBODIMENTS

Figure 1:
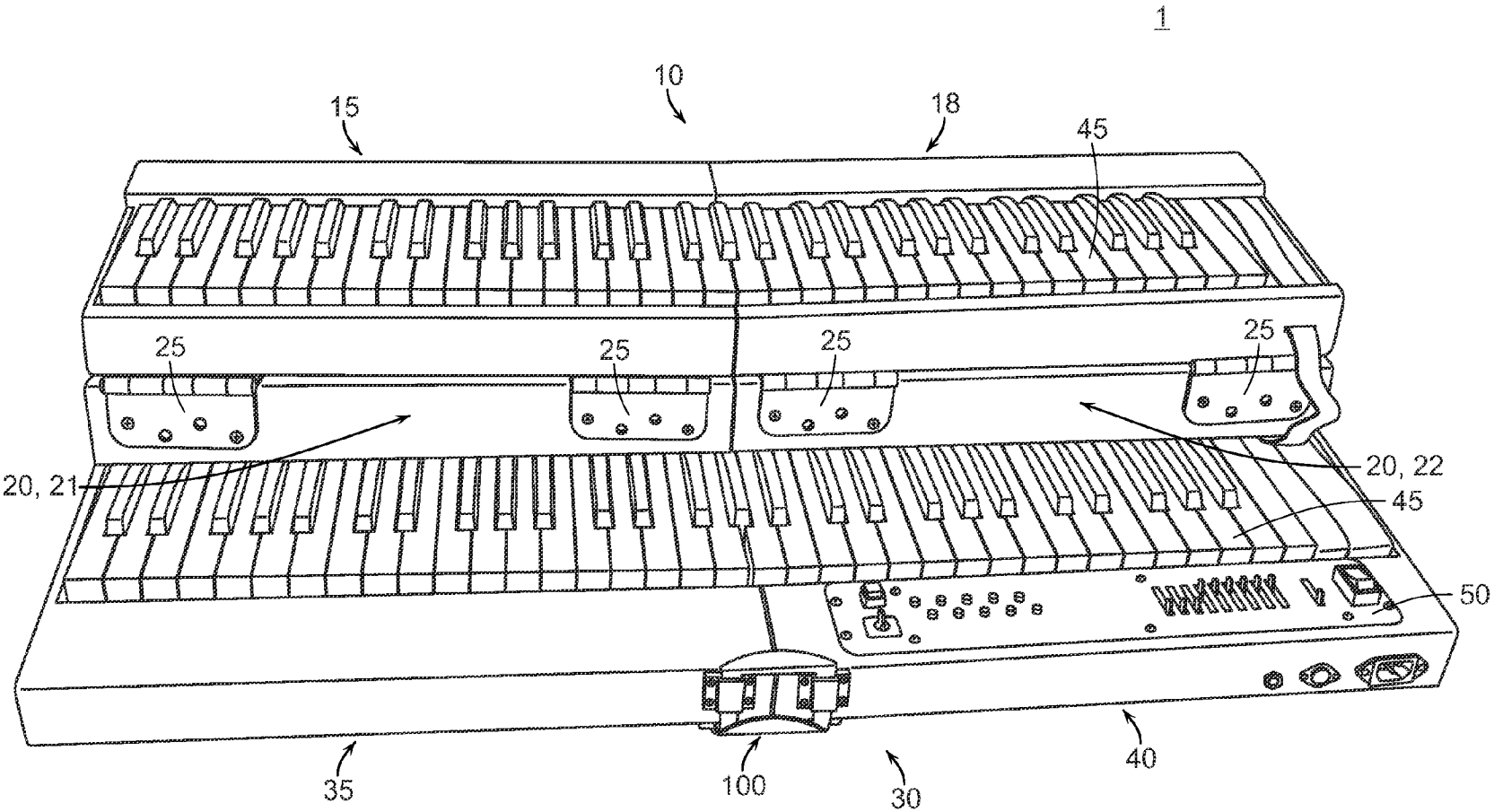
FIG. 1 shows a perspective view of a foldable musical keyboard player in a deployed configuration.

The preferred embodiments of the present invention will now be described with reference to the drawings. Identical elements in the various figures are identified, as far as possible, with the same reference numerals. Reference will now be made in detail to embodiments of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto without deviating from the innovative concepts of the invention.

FIG. 1 shows a perspective view of a foldable musical keyboard player in a deployed configuration. In the deployed configuration, the musical keyboard player is ready to be used in terms of access to all the music keys. Shown in FIG. 1 is the foldable music keyboard player 1 comprising a flippable top keyboard 10, a bottom keyboard 30, and a top back member 20, wherein the top back member is directly attached to the top of the bottom keyboard 30, and the flippable top keyboard 10 is connected to the top back member 20 with a series of horizontal hinges 25, allowing the flippable top keyboard 10 to flip over and cover the bottom keyboard 30. The flippable top keyboard 10 includes a top keyboard left section 15 and a top keyboard right section 18, the bottom keyboard 30 includes a bottom keyboard left section 35 and a bottom keyboard right section 40, the top back member 20 includes a top back left section 21 and a top back right section 22. On the playing sides of both the flippable top keyboard 10 and the bottom keyboard 30, there are music keys 45. Presented on the bottom keyboard is also a control panel 50. Also shown in FIG. 1 is a fastening assembly 100 including a fastening pin 110 and an anchoring member 135.

FIG. 1 shows the foldable musical keyboard player in a deployed configuration, wherein the flippable top keyboard is flipped up, exposing the music keys 45. The top keyboard left section 15 is longitudedly aligned with the top keyboard right section 18, and the bottom keyboard left section 35 is longitudedly aligned with the bottom keyboard right section 40. The bottom keyboard 30 and the flippable top keyboard 10 are generally parallel with the flippable top keyboard 10 on a higher level.

Figure 2A:
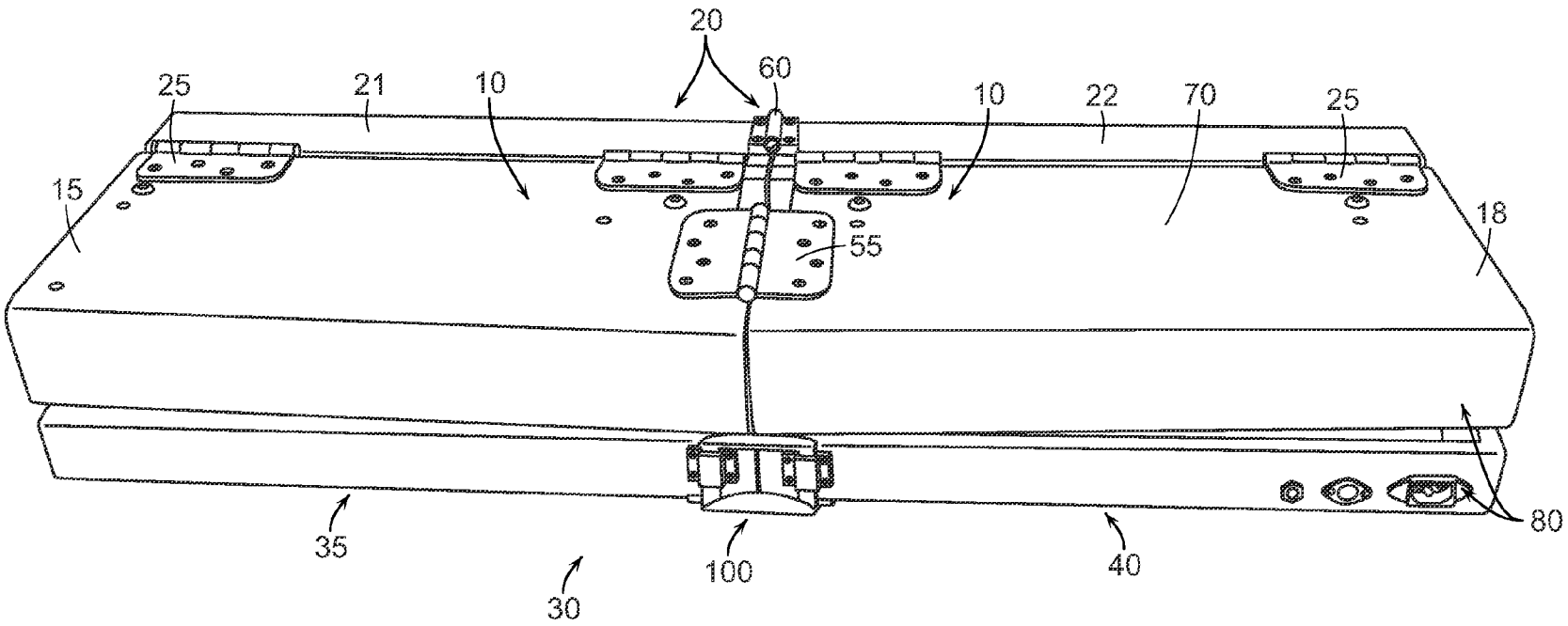
FIG. 2A shows a perspective view of the foldable musical keyboard player in a first folding configuration.

FIG. 2A shows a perspective view of the foldable musical keyboard player in a first folding configuration. In the first folding configuration, the music keys are no longer exposed and accessible and the musical keyboard player is not ready to be used. Shown in FIG. 2A is the foldable music keyboard player 1 comprising a flippable top keyboard 10, a bottom keyboard 30, and a top back member 20, wherein the top back member is directly attached to the top of the bottom keyboard 30, and the flippable top keyboard 10 is connected to the top back member 20 with a series of horizontal hinges 25, allowing the flippable top keyboard 10 to flip over and cover the bottom keyboard 30. The flippable top keyboard 10 includes a top keyboard left section 15 and a top keyboard right section 18, and the bottom keyboard 30 includes a bottom keyboard left section 35 and a bottom keyboard right section 40, the top back member 20 includes a top back left section 21 and a top back right section 22. The music keys 45 are no longer accessible in the first folding configuration.

As indicated by FIG. 2A, the top keyboard left section 15 and the top keyboard right section 18 are connected by a first vertical hinge 55 and the top back left section 21 and the top back right section 22 are connected by a second vertical hinge 60. In the first folding configuration, the flippable top keyboard 10 is flipped down, covering the bottom keyboard 30, wherein the top keyboard left section 15 generally overlaps with the bottom keyboard left section 35, and the top keyboard right section 18 generally overlaps with the bottom keyboard right section 40.

Referring to FIGS. 1 and 2A, as indicated above, it should be noted that the flippable top keyboard 10, though presented as a full-fledged keyboard with music keys, may simply comprise a flippable cover without any music keys and having a left section and a right section that overlap with the left section and right section of the bottom keyboard 30. The key feature here is that the flippable top may be flipped down along the horizontal hinges 25. What is shown in FIGS. 1 and 2A is the preferred embodiment.

Similar to the deployed configuration, in the first folding configuration as shown in FIG. 2A, the top keyboard left section 15 is longitudedly aligned with the top keyboard right section 18, and the bottom keyboard left section 35 is longitudedly aligned with the bottom keyboard right section 40. By flipping down (folding down) the flippable top keyboard 10, the music keys 45 and the control panel 50 are no longer accessible. The foldable musical keyboard player 1, in this configuration, generally has a cuboid shape with a keyboard player top 70, a keyboard player bottom 75 (not shown in FIG. 2A), keyboard player front side 80, and two keyboard player lateral side 85 (not shown in FIG. 2A). The "horizontal" hinges 25 and the "vertical" hinges 55 and 60 are defined based on the relative orientation of the hinges with the keyboard player front side 80. While the horizontal hinges 25 are generally parallel to the keyboard player front side 80, the vertical hinges 55 and 60 are generally perpendicular to the keyboard player front side 80.

It should also be noted that the embodiment shown in FIG. 2A only illustrates one possible way to design the foldable music keyboard player 1. After the first folding, the player may take any shape, such as an oval column or cylinder or any other irregular shape or pattern. The key feature is that the left sections, including the top keyboard left section 15, the top back left section 21, and the bottom keyboard left section 35, may be combined to a single block, and similarly the right sections, including the top keyboard right section 18, the top back right section 22, and the bottom keyboard right section 40, may be combined to another single block. Such a design allows the second folding to take place, pivoting the left sections against the right sections.

Figure 2B:
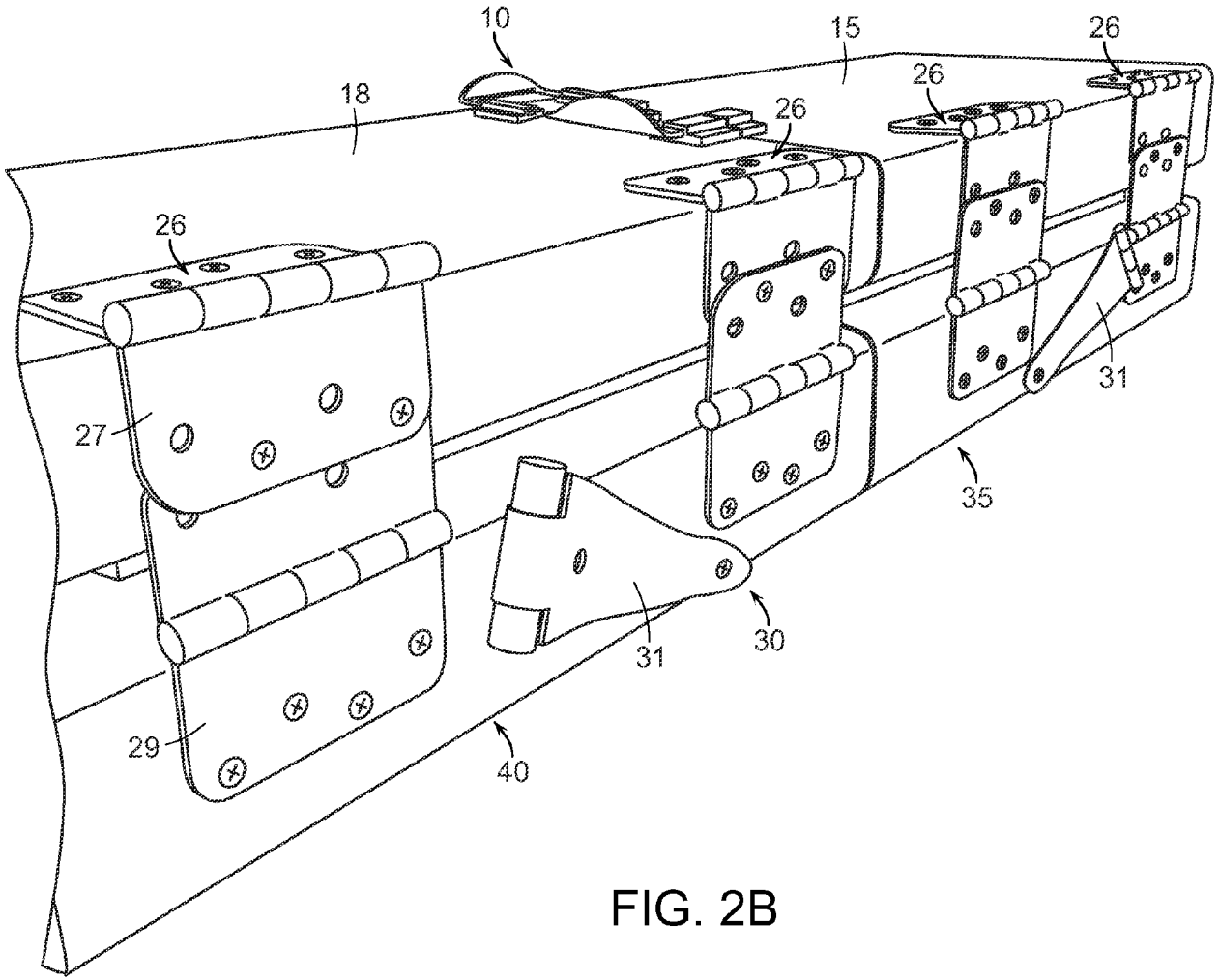
FIG. 2B shows a rear view of the foldable musical keyboard player in an alternate folding configuration.

In FIG. 2B shows a rear view of a foldable music keyboard player 1 in an alternative folding configuration with a double folding hinge 26. The double folding hinge 26 replaces the "horizontal" hinges 25 on the foldable music keyboard player 1 (see FIG. 2A). This configuration removes the top back left section 21 and top back right section 22 and connects the flippable top keyboard section 10 to the bottom keyboard 30. Typically, screws are employed to create a solid connection between the flippable top keyboard 10 and the bottom keyboard 30. However, rivets, snaps, or adhesives may also be used.

The foldable music keyboard player 1 has a flippable top keyboard 10. When flipped down, the flippable top keyboard 10 rests on top of the bottom keyboard 30 protecting the music keys 45 and control panel 50. The top left keyboard section 15 is longitudedly aligned with the top right keyboard section 18. When the flippable top keyboard 10 is put into a playing position, the double hinge 26 allows for rotational and lateral movement. This is achieved by the interaction between the top hinge 27 and the bottom hinge 29. The top hinge 27 is coupled to the flippable top keyboard 10 and the bottom hinge 29. The bottom hinge 29 is connected to the top hinge 27 and the bottom keyboard section 30. The flippable top keyboard 10 rotates approximately 180° into playing position. The sections of the double hinges 26 permit for the folding forward or backwards of the junction between the top hinge 27 and bottom hinge 29 thereby adjusting the position of the flippable top keyboard 10. Further, there are support hinges 31 affixed to the bottom keyboard 30. These support hinges 31 are angled in relation to the bottom keyboard 30 and have one section attached to the bottom keyboard 30 with another free section hingedly coupled to the affixed section. When folded out, the support hinge 31 holds up the top keyboard 10 to take stress off the double hinges 26. Additionally, it forms a more solid playing surface for the user.

Figure 3:
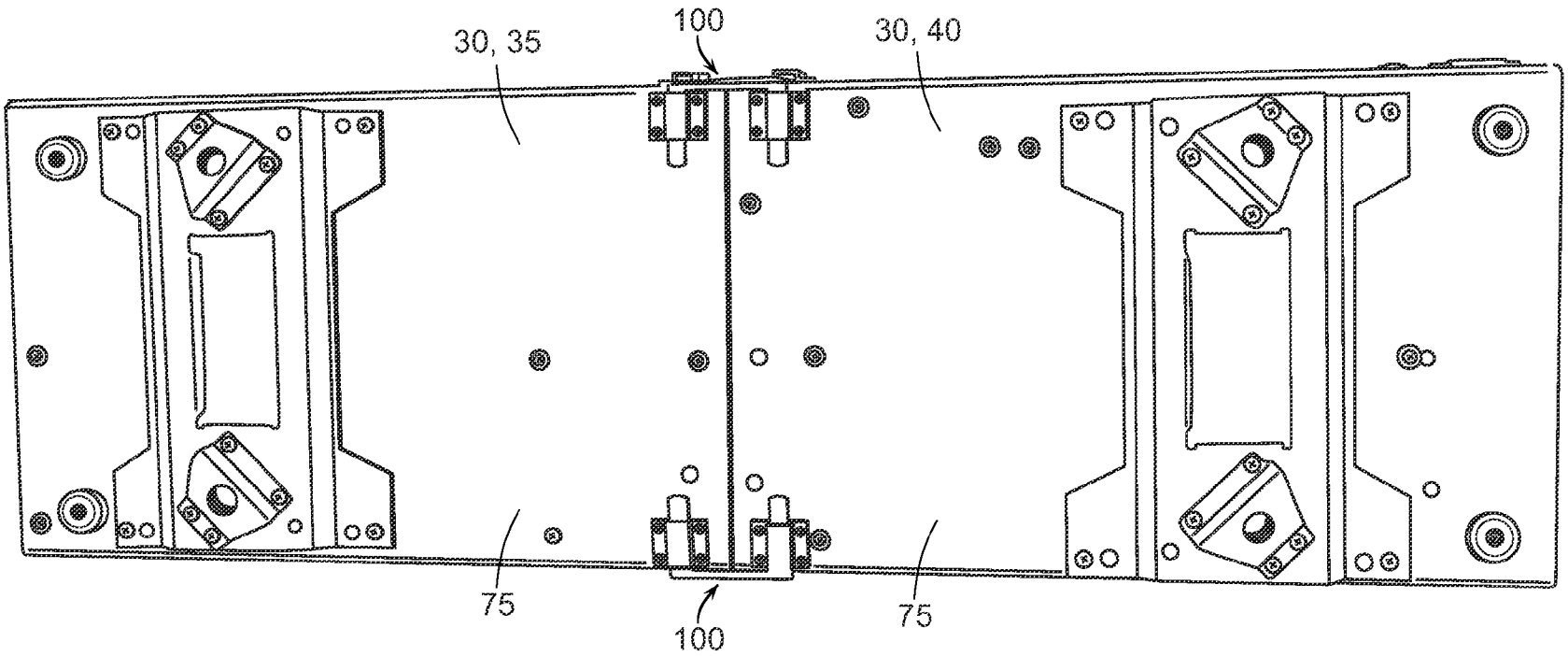
FIG. 3 shows a bottom view of the foldable musical keyboard player in a first folding configuration.

FIG. 3 shows a bottom view of the foldable musical keyboard player in a first folding configuration. Shown in FIG. 3 is the foldable music keyboard player 1 comprising: a bottom keyboard 30 having a bottom keyboard left section 35 and a bottom keyboard right section 40. As indicated in FIG. 2, the bottom keyboard left section 35 is longitudedly aligned with the bottom keyboard right section 40. There are two fastening assemblies 100 bridging the bottom keyboard left section 35 and the bottom keyboard right section 40, keeping the two sections in place. In terms of the entire foldable musical keyboard player 1, what is shown in FIG. 3 is the keyboard player bottom 75.

Figure 4:
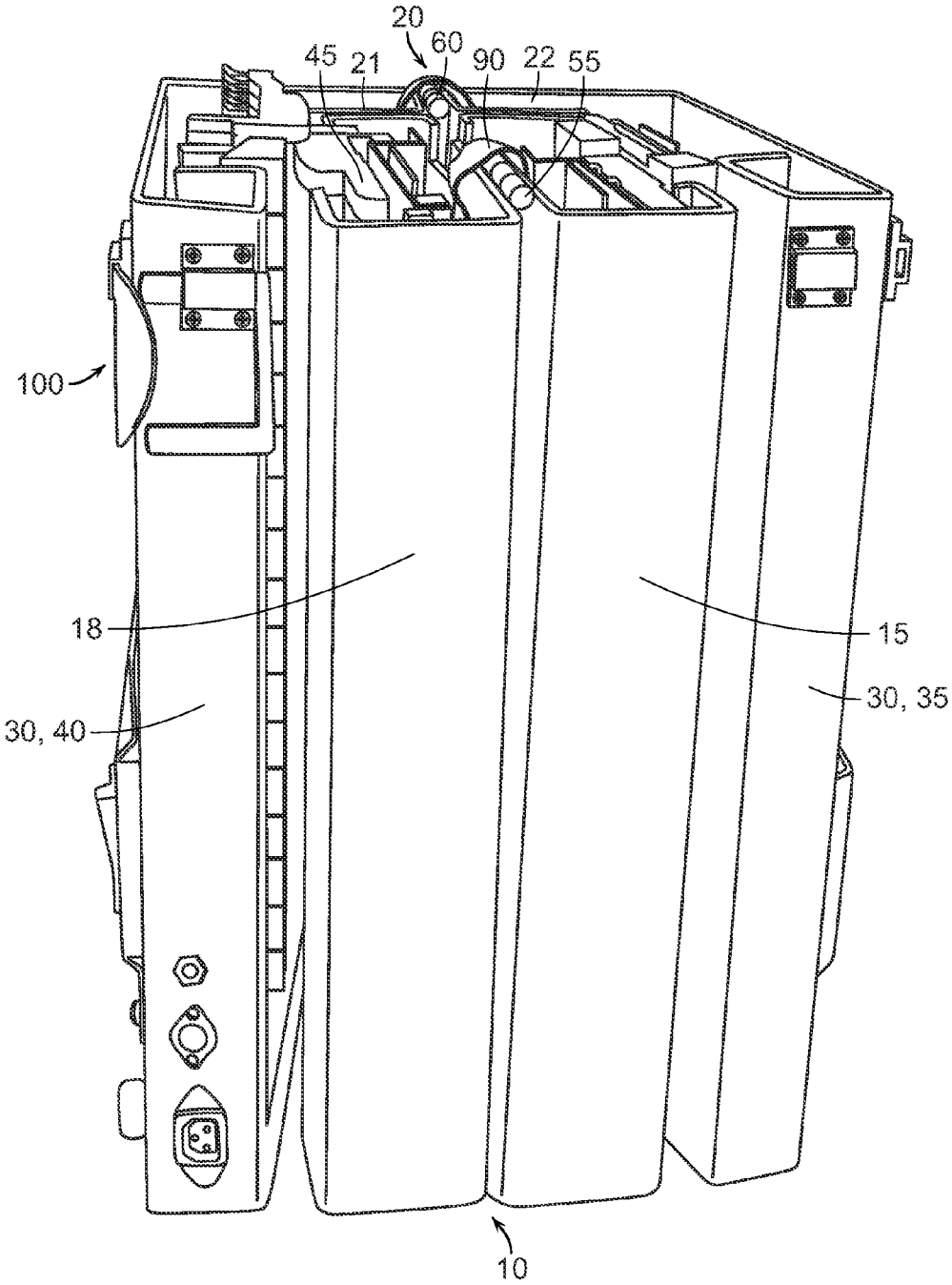
FIG. 4 shows a perspective view of the foldable musical keyboard player in a second folding configuration.

FIG. 4 shows a perspective view of the foldable musical keyboard player in a second folding configuration. In the second folding configuration, the musical keyboard player is in a compact state and the music keys are no longer accessible. The left section are folded against the right sections. Shown in FIG. 4 is the foldable music keyboard player 1 comprising: a flippable top keyboard 10 having a top keyboard left section 15 and top keyboard right section 18, a bottom keyboard 30 having a bottom keyboard left section 35 and bottom keyboard right section 40, and a top back member 20 having a top back left section 21 and top back right section 22. The left sections, including the top keyboard left section 15, the top back left section 21, and the bottom keyboard left section 35, combine to a left folding block. Similarly the right sections, including the top keyboard right section 18, the top back right section 22, and the bottom keyboard right section 40, combine to a right folding block. The left folding block and the right folding block fold along the first vertical hinge 55 and the second vertical hinge 60 against each other, making the foldable musical keyboard player 1 a compact structure that is readily portable in a bag or suitcase. From the openings exposed by the second folding, music keys 45 and connecting bands 90 are visible. Also shown in FIG. 4 are two fastening assemblies 100 in a released state. The detailed structures and functionality of the fastening assemblies are shown in FIGS. 5A and 5B.

As indicated above, it is not a requirement that the folded musical keyboard player takes a cuboid shape. Other shape may also be chosen as long as two consecutive foldings may be achieved. The essential feature is that the musical keyboard player 10 may be folded left-against-right in the middle of the musical keys.

The positioning of the fastening assemblies 100 and the hinges 25, 55 and 60 determines how in particular the keyboard player 1 may be folded. If the fastening assembly attaches to the left and right sections of the bottom keyboard 30 and the vertical hinges 55 and 60 are positioned on the top keyboard 10, then the keyboard player 1 of the current invention is preferably folded along the vertical hinges 55 and 70 that results in a direct pivoting of the left section 15 and right section 18 of the top keyboard against one another, after releasing the fastening assemblies 100. On the other hand, the fastening assemblies 100 may attach to the flippable top keyboard 10, while the vertical hinges 55 and 60 connect the left and right sections of the bottom keyboard 30. Such a design allows splitting of the top keyboard 10 and bending of the bottom keyboard 30. Both formats are acceptable.

Figure 5A:
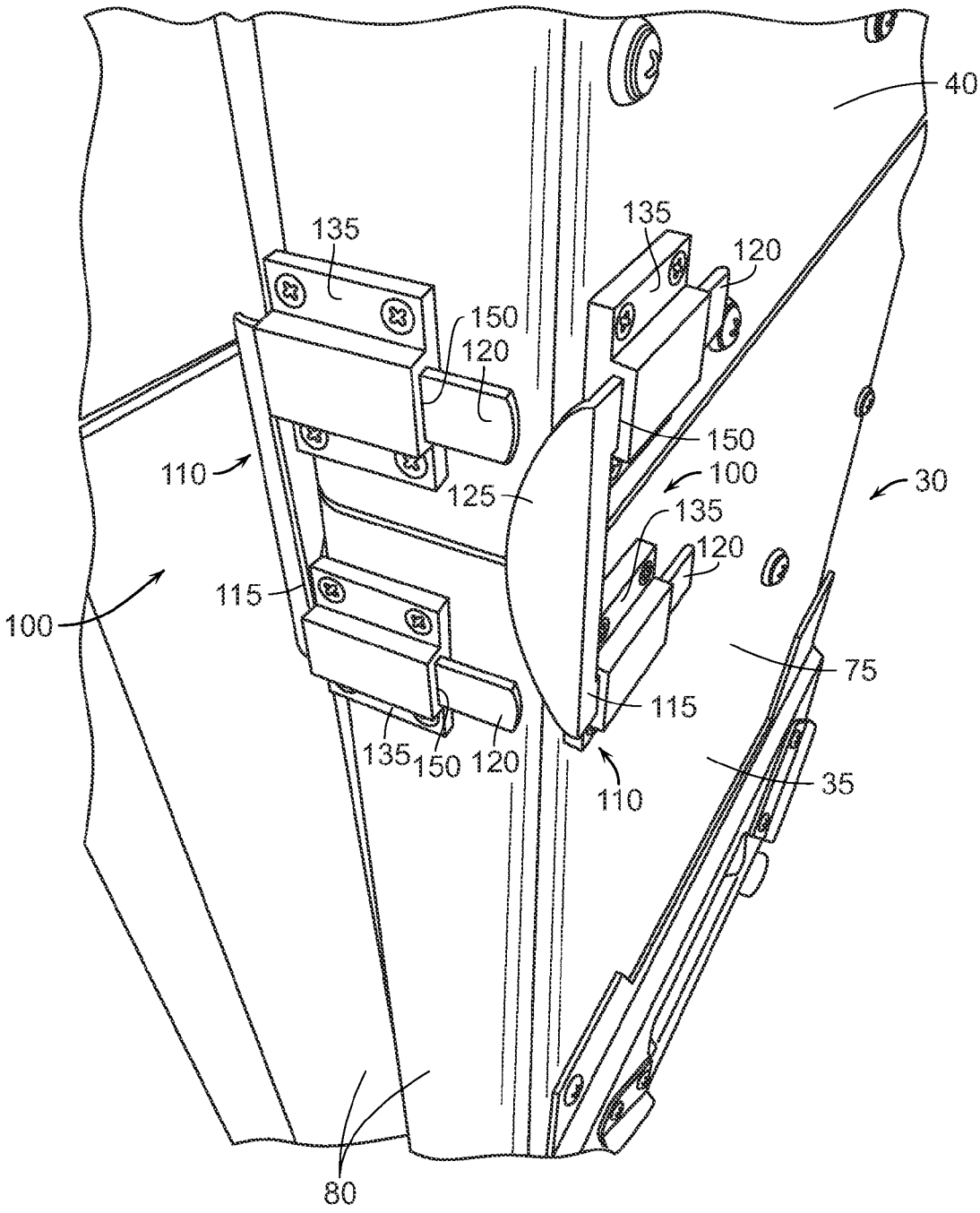
FIG. 5A shows a partial bottom perspective view of the foldable musical keyboard player in a first folding configuration, illustrating the locked fastening assemblies.
Figure 5B:
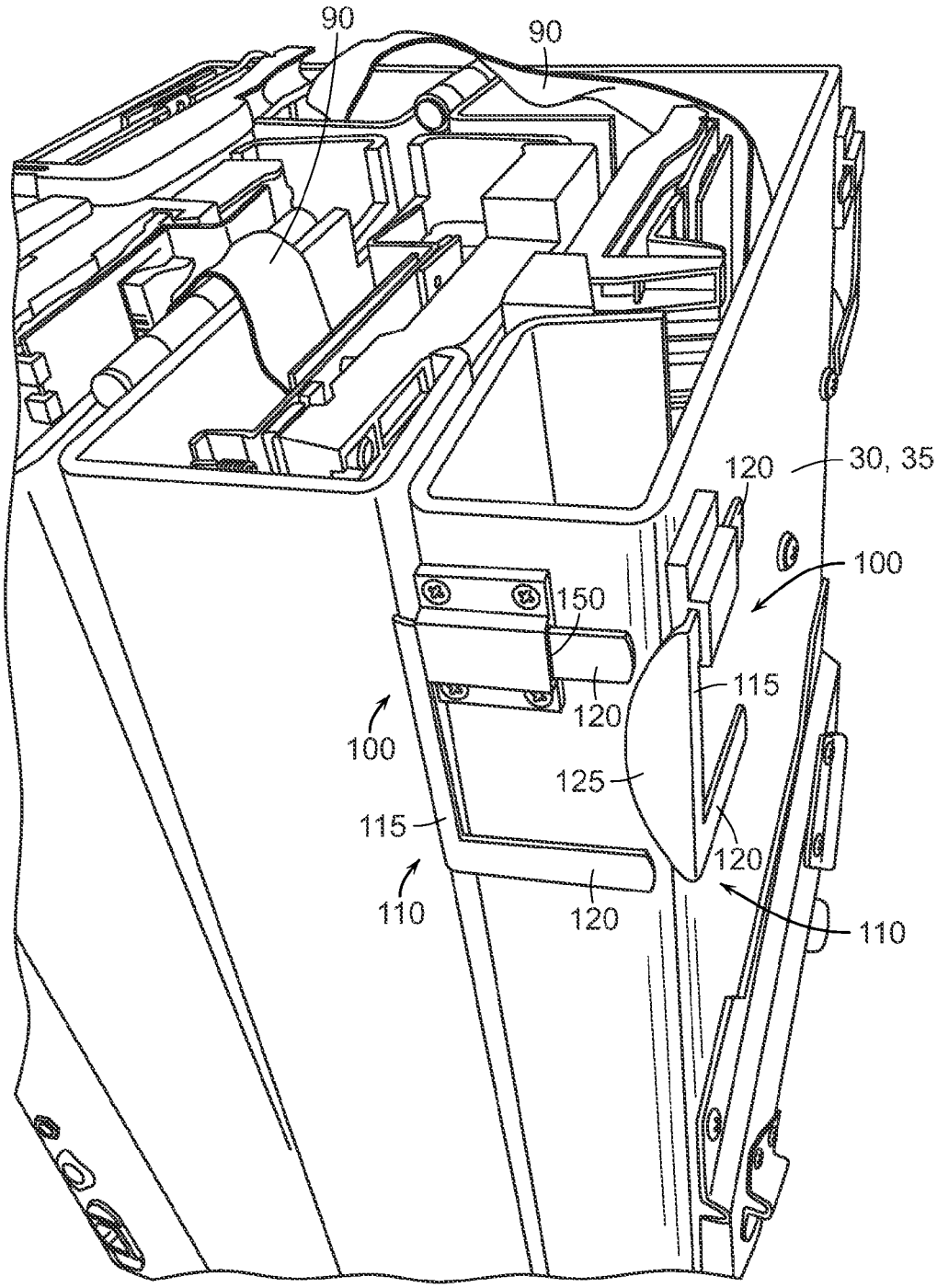
FIG. 5B shows a partial perspective view of the foldable musical keyboard player in a second folding configuration, illustrating the released fastening assemblies.

FIG. 5A shows a partial perspective view of the foldable musical keyboard player in a first folding configuration, illustrating the locked fastening assemblies. Shown in FIG. 5A is the foldable music keyboard player 1 comprising: a bottom keyboard 30 having a bottom keyboard left section 35 and a bottom keyboard right section 40. As indicated in FIG. 2, the bottom keyboard left section 35 is longitudedly aligned with the bottom keyboard right section 40. There are two fastening assemblies 100 bridging the bottom keyboard left section 35 and the bottom keyboard right section 40, keeping the two sections in place. In terms of the entire foldable musical keyboard player 1, what is shown in FIG. 5A is the keyboard player bottom 75 and the keyboard player front side 80.

Each fastening assembly 100 comprises a fastening pin 110 and two anchoring members 135, wherein the fastening pin 110 is in a "locked" position in FIG. 5A showing the first folding configuration. Preferably the fastening pin 110 is a "U" shaped structure with a pin base 115 and two pin prongs 120. Each anchoring member 135 may comprise an anchoring member slot 150 being affixed to the key board player, wherein the anchoring member slot 150 may fittingly receiving a pin prong 120. When the two anchoring members 135 are parallelly aligned on two adjacent sections, the two pin prongs 120 may be inserted into the two anchoring member slots 150, securing the relative positioning of the bottom keyboard left section 35 and bottom keyboard right section 40.

As shown in FIG. 5A, the fastening pin 110 may further comprise a pin blocker 125, the pin blocker 125 being a congruent part aligning with the pin base 115 and serving partially as a reinforcing structure of the pin base 115. Referring to FIG. 5A, for one fastening assembly 100, the anchoring members are attached to the keyboard player bottom 75, whereas the pin blocker 125 is generally perpendicular to the plane of the pin prongs 120. The insertion of the pin prongs 120 into the anchoring member slots 150 is not only controlled by the pin base 115, but also by the contact of the pin blocker 125 with the keyboard player front side 80. Such a design allows the fastening pin 110 to stay adjacent to two sides of the keyboard player, enhancing the functionality of the fastening assemblies 100.

FIG. 5B shows a partial perspective view of the foldable musical keyboard player in a second folding configuration, illustrating the released fastening assemblies. Shown in FIG. 5B is the foldable music keyboard player 1 having a bottom keyboard 30 wherein there are fastening assemblies 100 attached to the bottom keyboard 30. Here the fastening assemblies are released—the pin prongs 120 from the same fastening pin 110 are not inserted simultaneously into two anchoring member slots 150. Referring to FIGS. 5A and 2, the user may pull the fastening pin out—releasing the locked fastening assembly 100, and convert the musical keyboard player 1 from the first folding configuration to the second folding configuration, as shown in FIGS. 4 and 5B. Here in FIG. 5B one of the pin prongs 120 is inserted in an anchoring member slot 150, which serves to keep the fastening pins 110 close by. There is no specific requirement that the pin prongs 120 need to be kept in such a manner, though this is a preferred approach.

Referring to FIGS. 4 and 5B, there are connecting bands 90 linking the interior structures of the bottom keyboard 30 and the top keyboard 10. Such connecting bands 90 are used for data and electrical transfers that are needed for proper music play. The connections are kept in place whether the musical keyboard player is deployed or folded.

As shown in FIGS. 4 and 5B, in the second folding configuration, the musical keyboard player is in a compact arrangement. It may be easily put into a bag or suitcase and become much more portable. Since conversions between the configurations are not complicated, the musical keyboard player may be deployed and folded with ease, giving the user much more convenience.

The attachment assembly 100 may be made from any suitable material that is strong and durable. The materials that may be used include but are not limited to metal such as copper or stainless steel, wood, and hard plastics such as polyethylene terephthalate (PET), polyethylene (PE), high-density polyethylene, polyvinyl chloride (PVC), polyvinylidene chloride (PVDC), polypropylene (PP), polystyrene (PS), high impact polystyrene (HIPS) and polycarbonate (PC), or some combination thereof. Preferably the attachment assembly 100 is made from copper.

Although this invention has been described with a certain degree of particularity, it is to be understood that the present disclosure has been made only by way of illustration and that numerous changes in the details of construction and arrangement of parts may be resorted to without departing from the spirit and the scope of the invention.

What is claimed is:

1. A foldable musical keyboard player, comprising:

a bottom keyboard having a bottom keyboard left section and bottom keyboard right section;

a flippable top keyboard connected to the bottom keyboard with a plurality of horizontal hinges, allowing the flippable top keyboard to flip, pivot against, and cover the bottom keyboard, the flippable top keyboard having a top keyboard left section and a top keyboard right section;

and a least one fastening assembly, wherein the top keyboard left section lays upon the bottom keyboard left section when the flippable top keyboard covers the bottom keyboard, the top keyboard right section lays upon the bottom keyboard right section when the flippable top keyboard covers the bottom keyboard, locking the fastening assemblies keeps the bottom keyboard left section and bottom keyboard right section longitudedly aligned and keeps the top keyboard left section and top keyboard right section longitudedly aligned, and releasing the fastening assemblies allows the top keyboard left section, together with the bottom keyboard left section to be folded against the bottom keyboard right section with the top keyboard right section using at least one vertical hinge.

2. The foldable musical keyboard player of claim 1, wherein the fastening assembly attaches to the bottom keyboard.

3. The foldable musical keyboard player of claim 1, wherein the fastening assembly attaches to the flippable top keyboard.

4. The foldable musical keyboard player of claim 1, wherein:

a top keyboard left section is connected to the top keyboard right section with a first vertical hinge.

5. The foldable musical keyboard player of claim 4, wherein:

the top keyboard left section folds against the top keyboard right section along the first vertical hinge.

6. The foldable musical keyboard player of claim 1, further comprising:

a top back member disposed upon the bottom keyboard and in parallel with the flippable top keyboard.

7. The foldable musical keyboard player of claim 6, wherein the top back member has a top back member left section and a top back member right section, the top back left section, together with the top keyboard left section, covers the bottom keyboard left section, the top back right section, together with top keyboard right section, covers the bottom keyboard right section.

8. The foldable musical keyboard player of claim 7, wherein the top back left section is connected to the top back right section with a second vertical hinge.

9. The foldable musical keyboard player of claim 8, wherein:

the top back member left section folds against the top back member right section along the second vertical hinge.

10. The foldable musical keyboard player of claim 1, wherein:

the fastening assembly comprises:

a fastening pin and two anchoring members, wherein the fastening assembly is locked when the fastening pin attaches to the two anchoring members simultaneously.

11. The foldable musical keyboard player of claim 10, wherein:

the fastening pin is a U shaped structure with a pin base and two pin prongs, each anchoring member includes an anchoring member slot, and pin prongs are capable of being fittingly inserted into and removed from the anchoring member slot.

12. The foldable musical keyboard player of claim 11, wherein:

the anchoring members are attached to the bottom keyboard left section and the bottom keyboard right section, respectively.

13. The foldable musical keyboard player of claim 1, wherein:

there are music keys as parts of the flippable top keyboard and the bottom keyboard, and there is a control panel on the bottom keyboard.

14. The foldable musical keyboard player of claim 13, wherein:

flipping down the flippable top keyboard conceals all the music keys and the control panel.

15. The foldable musical keyboard player of claim 1, wherein:

there are two fastening assemblies linking the bottom keyboard left section and the bottom keyboard right section when the fastening assemblies are locked.

16. A foldable musical keyboard player, comprising:

a bottom keyboard having a bottom keyboard left section and bottom keyboard right section;

a flippable top keyboard connected to the bottom keyboard with a plurality of horizontal hinges, allowing the flippable top keyboard to flip, pivot against, and cover the bottom keyboard, the flippable top keyboard having a top keyboard left section and a top keyboard right section connected by a first vertical hinge;

a top back member disposed upon the bottom keyboard and in parallel with the flippable top keyboard, the top back member having a top back member left section and a top back member right section connected by a second vertical hinge;

and a least one fastening assembly attached to the bottom keyboard, the bottom assembly comprising a fastening pin and two anchoring members, wherein the top back left section, together with the top keyboard left section, covers the bottom keyboard left section, the top back right section, together with top keyboard right section, covers the bottom keyboard right section, the fastening assembly is locked when the fastening pin attaches to the two anchoring members simultaneously, locking the fastening assemblies keeps the bottom keyboard left section and bottom keyboard right section longitudedly aligned and keeps the top keyboard left section and top keyboard right section longitudedly aligned, and releasing the fastening assemblies allows 1) the top keyboard left section to fold against the top keyboard right section along the first vertical hinge, 2) the top back member left section folds against the top back member right section along the second vertical hinge, and 3) the bottom keyboard left section to fold against the bottom keyboard right section, and the top keyboard left section, together with the bottom keyboard left section to be folded against the bottom keyboard right section with the top keyboard right section using at least one vertical hinge.

17. The foldable musical keyboard player of claim 16, wherein:

the fastening pin is a U shaped structure with a pin base and two pin prongs, each anchoring member includes an anchoring member slot, and pin prongs are capable of being fittingly inserted into and removed from the anchoring member slot.

18. The foldable musical keyboard player of claim 16, wherein:

the anchoring members are attached to the bottom keyboard left section and the bottom keyboard right section, respectively.

* * * * *